United States Patent [19]

Wentink

[11] Patent Number: 4,570,399

[45] Date of Patent: Feb. 18, 1986

[54] PANEL LITE INSERT SYSTEM

[76] Inventor: James T. Wentink, Wheaton, Ill.

[21] Appl. No.: 615,228

[22] Filed: May 30, 1984

[51] Int. Cl.[4] ..... E06B 3/00

[52] U.S. Cl. ..... 52/208; 49/465; 52/213; 52/455

[58] Field of Search ..... 52/208, 213, 217, 455; 49/169, 171, 463, 465

[56] References Cited

U.S. PATENT DOCUMENTS

| | | | |
|---|---|---|---|
| 2,983,002 | 5/1961 | McEvoy et al. | 52/455 |
| 3,363,365 | 1/1968 | Laepple | 49/169 X |
| 3,979,796 | 9/1976 | MacDonald | 49/463 |
| 4,259,818 | 4/1981 | Stark | 52/208 |

*Primary Examiner*—J. Karl Bell

*Attorney, Agent, or Firm*—Edmond T. Patnaude

[57] ABSTRACT

A lite insert system for installation in a panel is disclosed. The system includes an external frame and an internal collar provided with a telescopic double tongue and groove engagement for adjusting the thickness of the insert to conform to the thickness of a particular panel. A plurality of spring clips mounted internally of the panel engage the external frame and secures it to the panel. The collar is secured by adhesive to the external frame.

7 Claims, 7 Drawing Figures

PANEL LITE INSERT SYSTEM

BACKGROUND OF THE INVENTION

This invention relates to panel lite inserts. More particularly, the invention relates to a panel lite insert assembly providing ease of installation and improved retention and appearance.

Panel lite inserts are assemblies having either single or double glazing and can be installed wherever a glazing such as a window is required. Lite inserts are particularly adapted for installation in existing structures such as garage doors and are typically of a two piece construction.

Heretofore, lite insert systems comprised two frame members each having an inner peripheral channel to which a glaze pane, such as a pane of glass, is mounted. For a single glaze application only one frame member is fitted with a glaze pane, and for double glaze installations, a glaze pane is fitted in each of the respective frame members. Typically, the frame members have T-shaped cross sections which fit in side by side relation during installation providing for adjustment to the thickness of the door or other structure in which they are being installed. Each frame member includes a peripheral flange for engaging the respective opposite sides of the door. Installation of these assemblies has required the use of fasteners such as pop rivets. Holes are first drilled through the flange of one frame member and through the door. After applying a bead of sealant around the opening, pop rivets are installed to secure the frame to the door. An adhesive is then applied to the interior side by side portions of each frame member, and the second member is pushed into the opening until its flange engages the door. The adhesive secures the frame members together. While these systems are effective, the use of pop rivets renders the installation very labor intensive. Also, the pop rivets remain exposed which detracts from the overall appearance of the finished installation.

SUMMARY OF THE INVENTION

In accordance with the preferred embodiment the lite system of the present invention provides for an external frame member having a peripheral flange adapted to be disposed against one surface of the door in which it is to be mounted. The heretofore requirement of attaching the frame member to the door by rivets or other fasteners is eliminated by use of a novel spring clip. The spring clip includes a portion for engaging the inner surface of the outside door panel and a hook for engaging a cooperating shoulder on the frame. During installation the clip is deflected to create a spring force to pull the frame tightly against the outer surface of the outside door panel. The clip remains hidden from view.

Another feature of the invention allows for alternatively providing either a single or equal thickness double glazing in the frame, and further provides for installing a glaze pane having an increased thickness. The preferred embodiment provides for installing the increased thickness glaze pane either as a single glazing or as a double glazing in combination with one thinner glaze pane. In accordance with still another feature of the invention, an internal frame in the form of a collar is slidably engaged through a double tongue and groove arrangement to the external frame providing for adjustment to the door thickness.

BRIEF DESCRIPTION OF THE DRAWINGS

The invention will become better understood after a reading of the following detailed description in conjunction with the accompanying drawings wherein.

DETAILED DESCRIPTION OF THE PREFERRED EMBODIMENT

Figure 1:
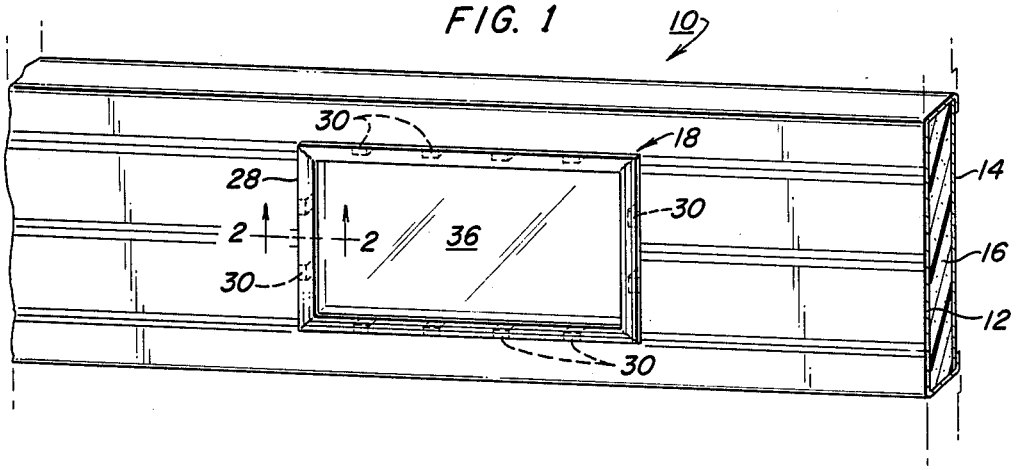
FIG. 1 is a perspective view of a door including a lite insert constructed according to the preferred embodiment of the invention.

Shown in FIG. 1 is a section of a panel 10 which is part of, for example, a door. The panel shown is a double wall panel including an external side member 12 and internal side member or skin 14. Insulation 16 is included between the two panels. The panel shown is representative only, and the invention is equally applicable to other structures such as hollow, double wall panels and single wall panels.

Figure 2:
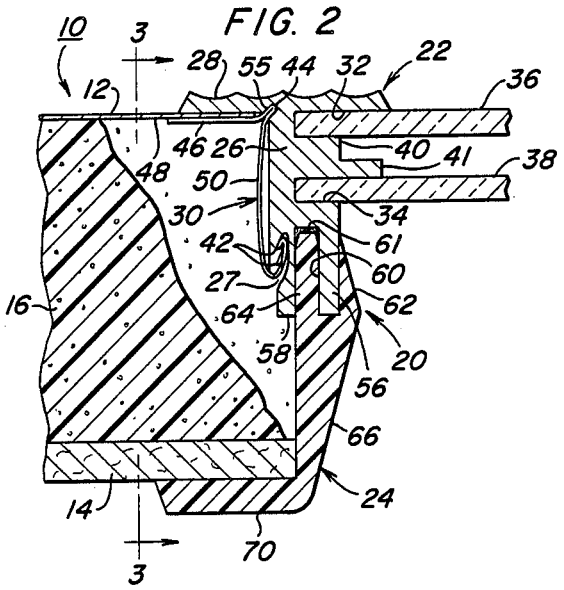
FIG. 2 is a transverse cross-sectional view taken along the line 2—2 of FIG. 1 showing details of construction of the preferred embodiment of the invention.
Figure 3:
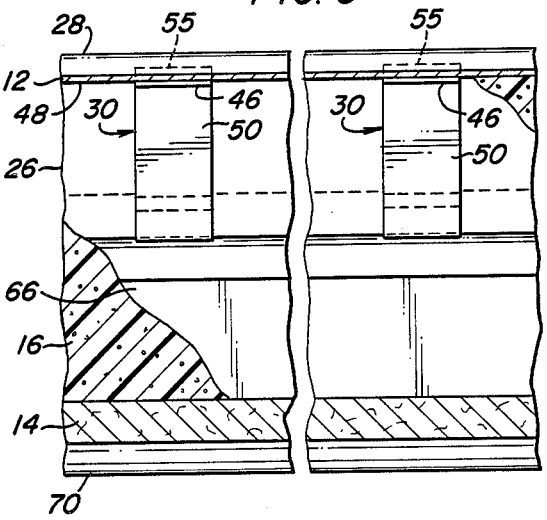
FIG. 3 is a cross-sectional view taken along the line 3—3 of FIG. 2.

A lite insert 18 is shown installed in an opening in panel 10 and includes the system set out herein. Referring to FIG. 2 lite insert 18 includes a frame indentified generally by the numeral 20 and which comprises an external frame member 22 and an internal frame member in the form of a collar 24. Member 22 includes a body portion 26 having an outer peripheral shape complementary to the opening in the panel so that it may be positioned therein. Member 22 may be seen to include a peripheral flange 28 that engages the outer surface of external side member 12.

As shown in FIG. 2, flange 28 is preferably substantially perpendicular to body portion 26 for use with flat surfaced doors. However, to adapt the frame for use with raised panel doors the flange can be made to form an acute angle with respect to the body portion as provided, for example, in the embodiment shown in FIG. 6. The acute angle allows the frame to be used with raised panels having angled surfaces, not shown, adjacent to the panel opening. The flange is thus angled from the body to provide for conformity of the flange 28 to the majority of raised panels.

Figure 6:
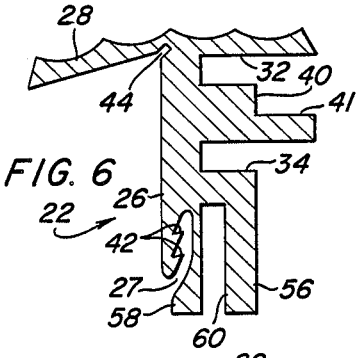
FIG. 6 is a cross-sectional view of the preferred embodiment of the external frame member showing details of construction.

The body of external frame member 22 is provided with two peripheral grooves 32, 34 having the same width and into which glaze panes 36, 38 are installed respectively. As best shown in FIGS. 2 and 6, body 26 is also provided with a peripheral recess 40 along a portion of one groove 32 which, in conjunction with groove 32, forms a third groove 41 having a width greater than groove 32. This structure provides for installing a glaze pane, not shown, that is thicker than could otherwise be installed in groove 32. The frame is therefore more versatile in that more applications can be covered with a single frame. That is, the frame can be manufacutred with a single glaze pane 36 in groove 32, a single glaze pane having an increased thickness installed in groove 41, as a double glazed lite having equal thickness panes 36, 38 installed in grooves 32, 34 or one thin pane 38 and one thick pane installed in grooves 34, 41 respectively.

Figure 4:
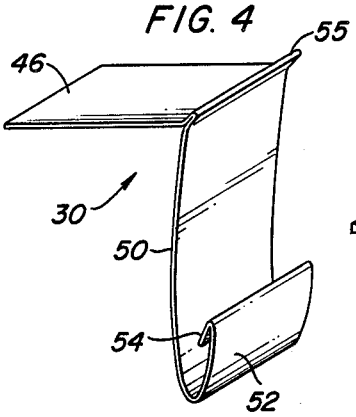
FIG. 4 is a perspective view of the preferred embodiment of the frame retention clip showing details of construction.
Figure 5:
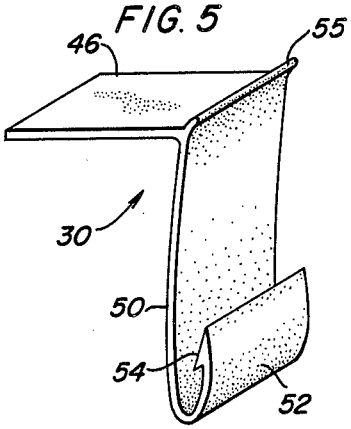
FIG. 5 is a perspective view of an alternative embodiment of the frame retention clip showing details of construction.

Referring to FIGS. 2 and 6, body 26 includes a channel 27 that opens into the door behind the body at a location adjacent the interior end of the body. The channel includes a plurality of abutments or shoulders 42 shown formed as barbed shaped steps. At the intersection of flange 28 and body 26 there is also provided a groove 44 which cooperates with a plurality of spring clips 30 to retain the frame in the panel. As shown in FIG. 1, clips 30 are positioned symmetrically around the opening in panel 10 and, as best shown in FIGS. 2 and 4, each clip includes a leg portion 46 for engaging the inside surface 48 of external side member 12 and a flexible and resilient elongated concave-convex leg portion 50 which, as shown in FIG. 4, has a portion 52 adjacent the free end folded back over itself. A smaller portion 54 at the free end is again folded back over portion 52 to form a hook. The intersection of leg portion 46 and elongated portion 50 is formed so as to create a raised tongue 55. As set out below, tongue 55 is received in groove 44 and prevents lateral movement of the clip. The clip shown in FIG. 4 is made from strapping material by appropriately bending the strapping to achieve the desired configuration. An alternative clip is shown in FIG. 5 as a plastic extrusion with the hook being formed as a barb.

Figure 7:
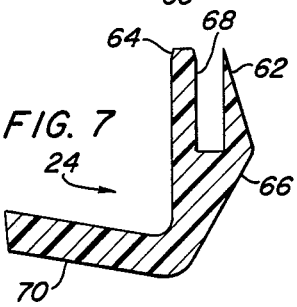
FIG. 7 is a cross-sectional view of the preferred embodiment of the frame collar showing details of construction.

As best shown in FIGS. 6 and 7, body 26 is also provided with a pair of parallel peripheral legs 56, 58 which form a peripheral groove 60 along the side of the frame member internally of the panel opening. Similar legs 62, 64 are included on collar body 66 to form a groove 68 in the collar. One frame leg, such as 56, is received in collar slot 68, and one collar leg, such as 64, is correspondingly received in frame body groove 60 forming a telescopic double tongue and groove attachment. Collar 24 is preferably plastic and is provided with a flexible flange 70 which is angularly disposed from the collar body, as shown in FIG. 7, forming an acute angle preferably of about 80°. When the collar is pushed into engagement with the frame during installation, flange 70 will deflect and tightly conform to the external surface of internal side member or skin 14. As with frame flange 28, the acute angle of collar flange 70 provides for conformity of the collar flange to a beveled surface around the interior side of the opening as is often provided in panel doors. The telescopic double tongue and groove structure allows the spacial separation of the frame and collar flanges to be adjusted to compensate for dimensional tolerances in the thickness of the particular panel in which the lite system is being installed. Different sizes of the collar 24 may be provided for use in the substantially different door thicknesses.

INSTALLATION

To install the lite system in a door, the desired frame size is chosen and an opening is cut in the panel to accommodate the frame. The size of the opening is not critical and only need be sufficiently large so that the external frame member body can be inserted in the door with the flange against the external surface of the external side member and the collar flange against the external surface of the internal side member. It will be understood that in accordance with normal installation practices a bead of sealant is applied to the external surface of the door around the opening before the external frame is set in place. In the case of insulated doors, such as that shown in FIG. 1, a portion of the insulation may be removed at locations around the opening where the retention clips are to be located. The number of clips used depends on the size of the particular lite to be installed and they are preferably located symmetrically around the opening. Each clip is pressed into place with leg portion 46 against inner surface 48 of external side member 12 with concavo-convex leg 50 extending into the door interior with the hook portion facing the opening.

As each of the clips 30 are pressed into the position shown in FIG. 2, the leg 50 is deflected and a spring force is developed which locks the skin member 12 between the clip leg 46 and the inner surface of the flange 28. The hook 54 is caused to engage successive ones of the abutments 42 to firmly lock the frame member 22 to the panel.

With the external frame member retained in the door an adhesive-sealant 61 is applied to the grooves 60 of the frame body and to the external surface of the member 14 around the opening. The collar is then inserted into the opening from the internal side of the door and pushed to bring flange 70 flush against the door internal side member 14. Because flange 70 is flexible, it deflects and assumes the contour of the external surface of internal side member 14. The adhesive is preferably fast setting and secures the collar to the external flame and to the member 14 completing the installation.

The lite insert system can also be used to install a lite in single wall doors by fastening the external frame member to the wall as heretofore described without using the frame collar.

It can be seen that unsightly rivets or fasteners, and the need to drill holes to receive such fasteners is eliminated. The retaining clips 30 remain hidden from view and a clean attractive appearance is maintained on the external side of the door. Frame member 22 is preassembled with the appropriate glazing combination and required peripheral shape and size. Collar 24 is also manufactured according to the application dimensional requirements. The system thereby reduces the number of frame configurations that need to be manufactured and stocked to cover popular glazing applications.

Having described the preferred embodiment of the invention, those skilled in the art having the benefit of said description and the accompanying drawings can readily devise other embodiments and modifications. Therefore, said other embodiments and modifications are to be considered to be included within the scope of the appended claims.

What is claimed is:

1. A lite insert system for a panel, said panel comprising a first surface member having outer and inner sides, said system comprising:

a first frame for insertion into an opening in said panel, said frame including a body portion and a peripheral flange extending therefrom, said flange adapted for disposition against the outer side of said surface member around said opening, said body portion having a groove spaced from said flange and extending inwardly of the body portion in a direction generally toward said flange, said groove defining a wall internal to said body portion;

a glaze pane mounted in said frame; and a plurality of clips positioned around said opening, said clips each including a first leg portion for abutment against the inner side of said surface member, a second leg portion extending from an end of said first leg portion, and a third leg portion extending from an end of said second leg portion, said third leg portion adapted to be received within the groove of said body portion and to grip said wall of the groove, whereby said first leg portion is retained in abutment against the inner side of said surface member and said frame is retained within said opening of said panel.

2. A lite insert system according to claim 1 wherein each of said clips comprises hook means disposed at the distal end of said third leg portion for engagement with said wall of said groove.

3. A lite insert system according to claim 2 wherein the wall of said groove of said body member is provided with at least one shoulder for engagement with the hook means of said clips.

4. A lite insert system according to claim 2 wherein the second leg portion is resilient and acts to bias the flange of the frame in abutment with the outer side of said surface member when said hook means is in engagement with said wall of said groove.

5. A lite insert system according to claim 4 wherein the frame is provided with a second groove disposed proximate to the junction between the flange and body portion and each of said spring clips is provided with a tongue for insertion into said second groove of the frame whereby the clip is restrained against lateral movement with respect to said frame.

6. A lite insert system according to claim 1 comprising a second surface member having an outer side opposite the outer side of said first surface member, said system including a second frame having a body portion and a peripheral flange extending therefrom for disposition against the outer side of said second surface member, the body portion of said second frame having a tongue, said tongue and groove cooperating to join said frames together in fixed relation one to another.

7. A lite insert system according to claim 6 wherein said tongue is telescoping within said groove whereby the insert system is adaptable to panels of different thicknesses.

* * * * *